US010499751B2

(12) United States Patent
Maslana et al.

(10) Patent No.: US 10,499,751 B2
(45) Date of Patent: Dec. 10, 2019

(54) DISPENSER OF BAGGED FROZEN FOOD

(71) Applicant: Prince Castle LLC, Carol Stream, IL (US)

(72) Inventors: Eugene S. Maslana, Arlington Heights, IL (US); Dennis Malkowski, Yorkville, IL (US); Brian Smetana, Downers Grove, IL (US)

(73) Assignee: Prince Castle LLC, Carol Stream, IL (US)

( * ) Notice: Subject to any disclaimer, the term of this patent is extended or adjusted under 35 U.S.C. 154(b) by 0 days.

(21) Appl. No.: 16/157,830

(22) Filed: Oct. 11, 2018

(65) Prior Publication Data

US 2019/0110609 A1 Apr. 18, 2019

Related U.S. Application Data

(60) Provisional application No. 62/571,589, filed on Oct. 12, 2017.

(51) Int. Cl.
*A47F 7/00* (2006.01)
*A47F 1/12* (2006.01)

(52) U.S. Cl.
CPC ..... *A47F 1/121* (2013.01); *A47F 7/0071* (2013.01)

(58) Field of Classification Search
None
See application file for complete search history.

(56) References Cited

U.S. PATENT DOCUMENTS

| | | | | |
|---|---|---|---|---|
| 3,252,434 | A * | 5/1966 | Young, Jr. | A47F 5/13 108/181 |
| 3,915,097 | A * | 10/1975 | Young, Jr. | A47F 5/12 108/163 |
| 3,923,159 | A | 12/1975 | Taylor et al. | |
| 4,331,243 | A | 5/1982 | Doll | |
| 4,729,480 | A * | 3/1988 | Groover | G07F 11/28 211/59.2 |
| 4,901,869 | A | 2/1990 | Hawkinson et al. | |
| 4,955,486 | A | 9/1990 | Trulaske, Sr. | |
| 5,022,535 | A | 6/1991 | Spamer | |
| 5,450,968 | A | 9/1995 | Bustos | |
| 5,593,048 | A | 1/1997 | Johnson | |
| 5,595,310 | A | 1/1997 | Spamer et al. | |
| 6,164,462 | A | 12/2000 | Mumford | |
| 6,227,385 | B1 | 5/2001 | Nickerson | |
| 6,311,852 | B1 | 11/2001 | Ireland | |
| 6,409,028 | B2 | 6/2002 | Nickerson | |
| 6,604,638 | B1 | 8/2003 | Primiano et al. | |
| 6,786,341 | B2 | 9/2004 | Stinnett et al. | |
| 6,886,699 | B2 | 5/2005 | Johnson et al. | |

(Continued)

*Primary Examiner* — Gene O Crawford
*Assistant Examiner* — Ayodeji T Ojofeitimi
(74) *Attorney, Agent, or Firm* — Andrus Intellectual Property Law, LLP

(57) ABSTRACT

An organization system is used to store bagged food products in a temperature controlled environment. The organization system includes opposed side walls. A dispensing ramp is arranged at an angle between the opposed side walls. A front wall extends between the opposed side walls. A space between the front wall and the dispensing ramp define a dispenser opening. A divider wall extends between the opposed side walls. The divider wall extends in an elongated dimension with a lower end spaced apart from the dispenser ramp by a predetermined distance.

20 Claims, 6 Drawing Sheets

(56) References Cited

U.S. PATENT DOCUMENTS

| | | | | |
|---|---|---|---|---|
| 7,028,852 | B2 | 4/2006 | Johnson et al. | |
| 7,124,898 | B2 | 10/2006 | Richter et al. | |
| 7,213,722 | B2 | 5/2007 | Nagelski et al. | |
| 7,681,743 | B2 | 3/2010 | Hanretty et al. | |
| 7,854,333 | B2 | 12/2010 | Kottke et al. | |
| 7,918,365 | B2 * | 4/2011 | White | A47F 1/087 221/123 |
| 7,922,437 | B1 * | 4/2011 | Loftin | A47F 1/087 414/412 |
| 7,992,747 | B2 | 8/2011 | Bauer | |
| 8,016,139 | B2 | 9/2011 | Hanners et al. | |
| 8,939,421 | B1 | 1/2015 | Bryson et al. | |
| 8,967,393 | B2 | 3/2015 | Bryson et al. | |
| 9,713,395 | B2 | 7/2017 | Pichel | |
| 2005/0189310 | A1 | 9/2005 | Richter et al. | |
| 2006/0131321 | A1 * | 6/2006 | Nagelski | A47F 1/087 221/67 |
| 2008/0229778 | A1 | 9/2008 | Shelton | |
| 2014/0312053 | A1 * | 10/2014 | Yamagami | G07F 9/105 221/150 R |
| 2017/0007040 | A1 | 1/2017 | Howard et al. | |
| 2017/0164762 | A1 | 6/2017 | Bryson | |

* cited by examiner

DISPENSER OF BAGGED FROZEN FOOD

CROSS-REFERENCE TO RELATED APPLICATION

The present application claims priority of U.S. Provisional Patent Application No. 62/571,589, filed on Oct. 12, 2017, the content of which is hereby incorporated herein by reference in its entirety.

BACKGROUND

The present disclosure relates to organizational systems. More specifically, the present disclosure relates to organizational systems for bagged products. Embodiments as disclosed herein are related to the organization and dispense of bags of multiple individual frozen food products, for example chicken nuggets or the like from a freezer.

Restaurant and food preparation settings, particularly a quick service restaurant (QSR), meet customer order volume and speed expectations by cooking, heating, or otherwise assembling food that is previously prepared or partially prepared once an order is placed. The pre-prepared or partially prepared foods may be frozen to facilitate supply chain, transportation, and storage of the pre-prepared foods prior to preparation for delivery to a customer. These foods commonly include foods which are cooked in a deep fryer, including, but not limited to French fries, tater tots, jalapeno poppers, onion rings, breaded mushrooms or cheese curds, mozzarella sticks, chicken nuggets, and chicken tenders, although it will be recognized that other foods may be similarly used and prepared. The loose individual food items are held in pre-portioned bags in a freezer prior to use. While pre-portioned bags are convenient for portion management, these bags are difficult to keep organized in a freezer.

Article management solutions are available to organize shelves, coolers, vending machines, for the dispense of articles. Often these management solutions are designed for merchandising or selling goods to a consumer. Examples of available solutions can be found in U.S. Pat. No. 3,923,159 entitled "Product Display and Article Dispensing Device"; U.S. Pat. No. 4,331,243 entitled "Gravity Flow Rack"; U.S. Pat. No. 4,955,486 entitled "Gravity Feed Shelf"; U.S. Pat. No. 6,311,852 entitled "Merchandising Fixture and shelf divider system therefor"; U.S. Pat. No. 7,124,898 entitled "Merchandising System" U.S. Pat. No. 7,213,722 entitled "Merchandise Dispenser with Time Delay and One-Way Retaining Member", each of which are incorporated by reference herein in their entireties. However, such systems are not particularly adapted to organize bagged food products in a frozen environment.

Freezer organization of these bags present challenges in the food preparation setting. Loose bags of food products can intermingle, thus making it more difficult to find the appropriate bag within the freezer. Due to the flexibility/shiftability of the food within the bags, bags stacked within the freezer may become unstable with a risk of falling out of the freezer when a freezer door is opened. Finally, current systems are challenging for inventory control and management, particularly when stored food is typically preferred to be used on a first in, first out basis for consistent food quality and freshness.

Therefore, solutions are desirable for organization and dispense of bags of frozen food products that alleviate these challenges.

BRIEF DESCRIPTION OF THE DRAWINGS

An exemplary embodiment of an organization system for use with bagged food product in a temperature controlled environment. The organization system includes opposed side walls and a dispensing ramp arranged at an angle between the opposed side walls. A front wall extends between the opposed side walls and a space between the front wall and the dispensing ramp defines a dispenser opening. A divider wall extends between the opposed side walls. The divider wall extends in an elongated dimension with a lower end spaced apart from the dispenser ramp by a predetermined distance.

In further exemplary embodiments, the divider wall is a first divider wall. A rear wall extends between the opposed side walls. A second divider wall extends between the opposed side walls at a position between the first divider wall and the rear wall. The second divider wall extends in an elongated dimension with a lower end of the second divider wall spaced apart from the dispenser ramp by the predetermined distance. The predetermined distance may be based upon a dimension of a bagged food product such that the bagged food product deforms to move through the predetermined distance between the second divider wall and the dispenser ramp and the first divider wall and the dispenser ramp. A plurality of side projections located along interior surfaces of the opposed side walls.

The side projections are arranged parallel to the dispenser ramp. The first divider wall may be spaced apart from the front wall by a predetermined width and the second divider wall may be spaced apart from the rear wall by the predetermined width. The predetermined width is based upon a dimension of a bagged food product such that the bagged food product forms a first stack between the front wall and the first divider wall and forms a second stack between the second divider wall and the rear wall. A unitary bag chute may include the dispensing ramp, the rear wall, and a landing platform that extends from the dispensing ramp exterior of the dispenser opening. A landing platform extends from the dispensing ramp exterior of the dispenser opening. A shelf lock is pivotably secured to an end of the landing platform. The shelf lock includes at least one finger extending from a free end of the shelf lock. A retainer gate may include a weighted free end and be pivotably attached to the front wall to movably and partially occlude the dispenser opening. An elastomeric runner may be secured to a bottom of the organization system.

In an exemplary embodiment of the organization system, a retainer gate is pivotably attached to the front wall to movably and partially occlude the dispenser opening. The retainer gate may be weighted at a free end of the retainer gate. The retainer gate may further include a tube positioned about a portion of the retainer gate.

In further exemplary embodiments of the organization system, the opposed sidewalls each include a frame bar that defines an outer perimeter of a respective sidewall and the opposed sidewalls are formed by a plurality of U-shaped wires secured between the frame bars of both of the opposed sidewalls. The U-shaped wires may define a bottom frame between the opposed sidewalls. A runner may include a plurality of recesses and receive each of the U-shaped wires of the bottom frame within a respective recess of the plurality of recesses. A retaining plate may be secured to the at least one runner over the plurality of recesses to secure the U-shaped wires within the recesses of the plurality of recess. At least one retaining ring may secure the front wall, opposed side walls, the dispensing chute, the divider walls, and a rear wall together by a compression fit. A plurality of side projections are located along interior surfaces of the opposed side walls. The side projections are arranged parallel to the dispenser ramp and are connected at least between opposed sides of each of the frame bars. The plurality of side projections of a respective sidewall are secured to each of the U-shaped wires of the respective sidewall. A plurality of side support rods secured to each of the opposed side walls in an arrangement orthogonal to the dispensing ramp, wherein the dispensing ramp comprises a plurality of wires arranged orthogonal to the plurality of side support rods.

BRIEF DESCRIPTION OF THE DRAWINGS

Figure 1:
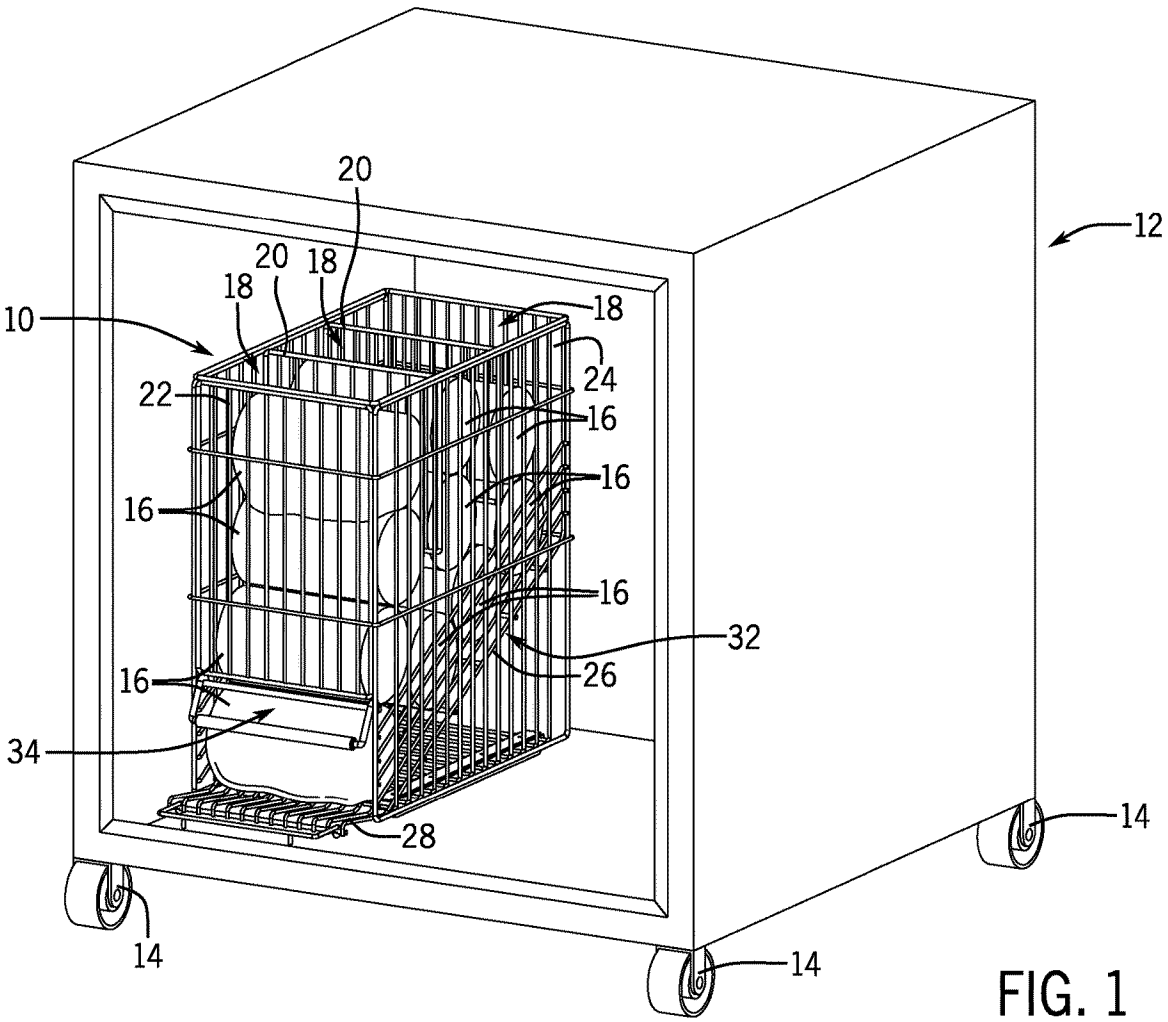

FIG. 1 is an environmental view of an exemplary embodiment of an organization system in a freezer.

Figure 2:
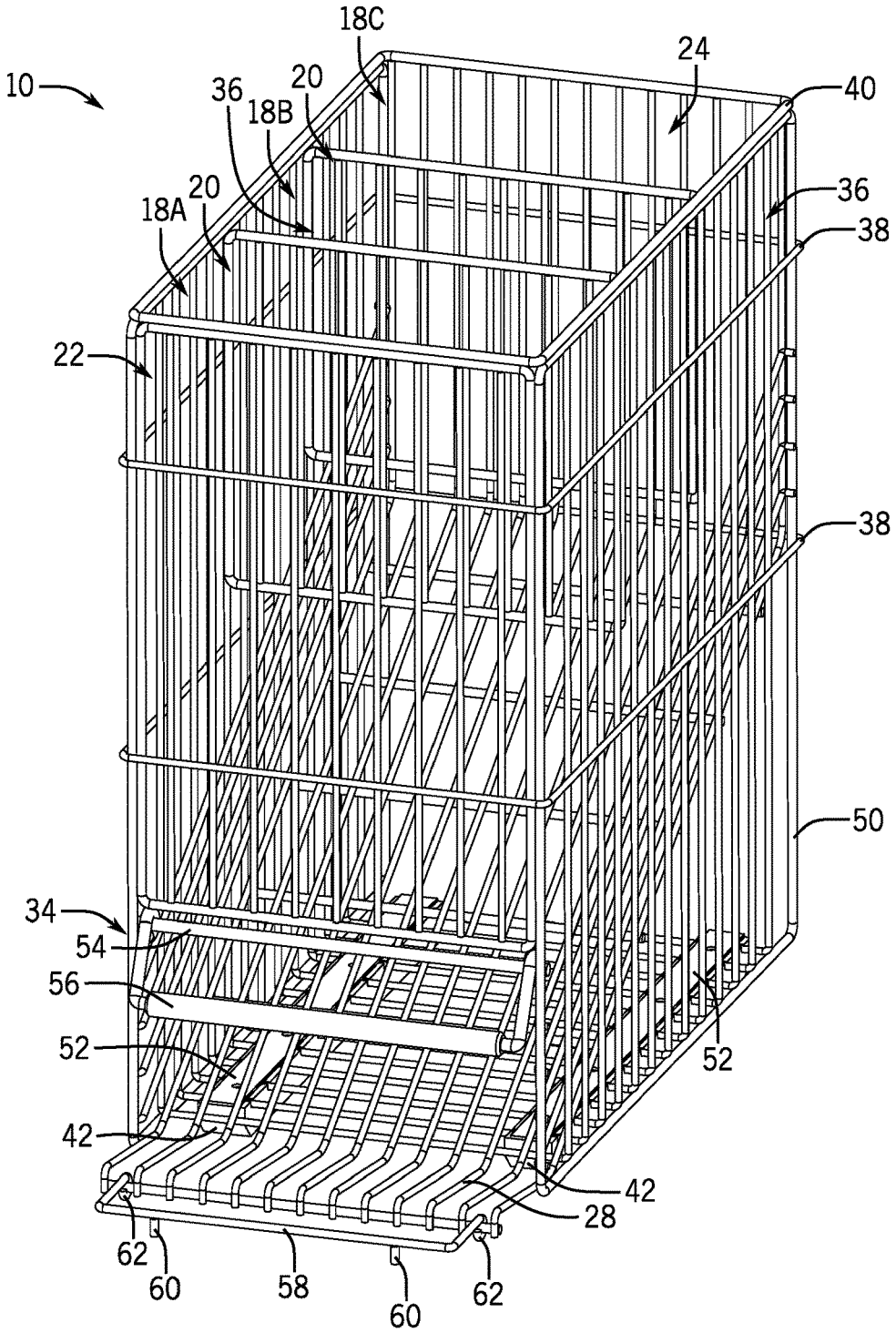

FIG. 2 is a front perspective view of an exemplary embodiment of an organization system.

Figure 3:
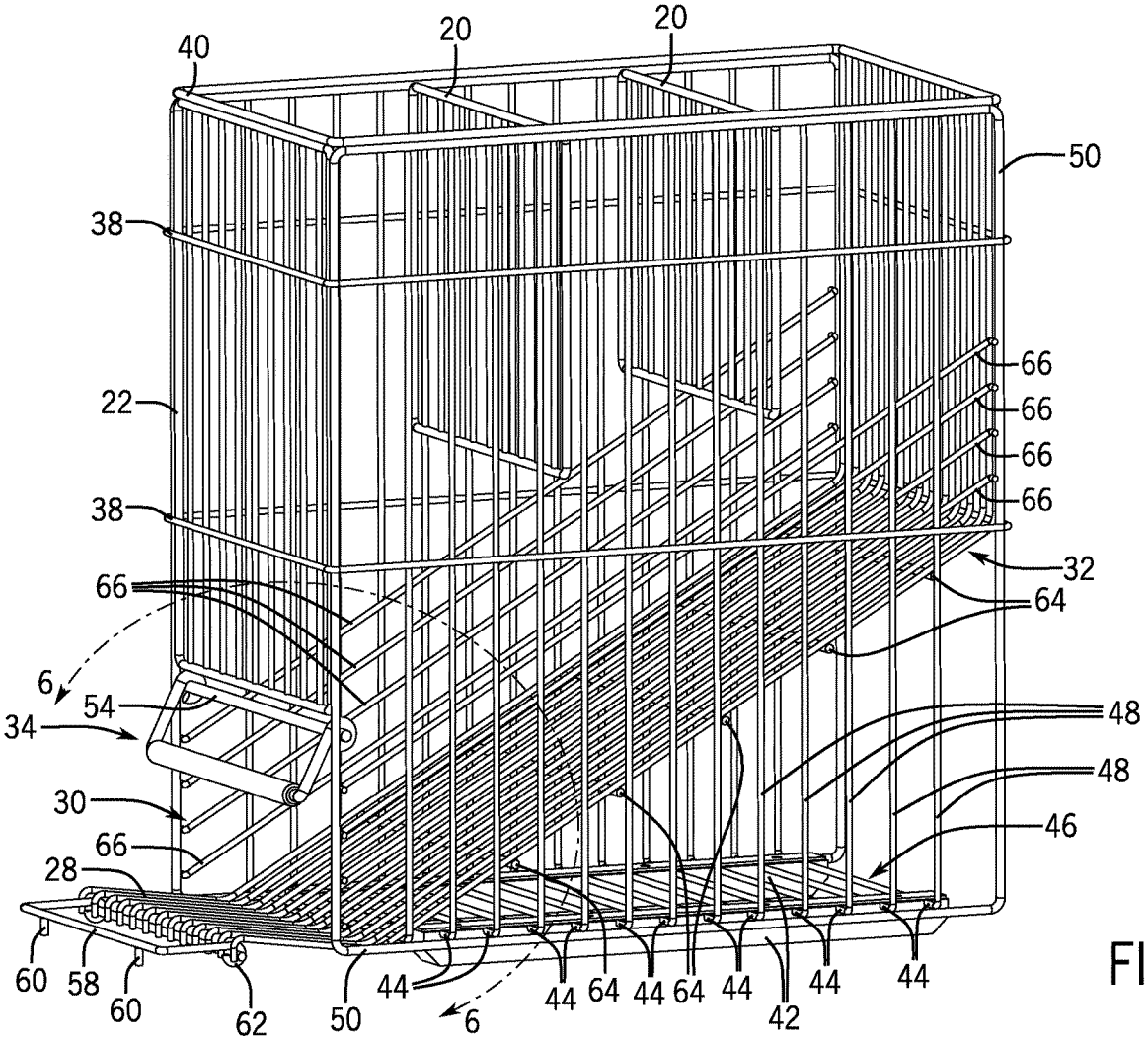

FIG. 3 is a side perspective view of an exemplary embodiment of an organization system.

Figure 4:
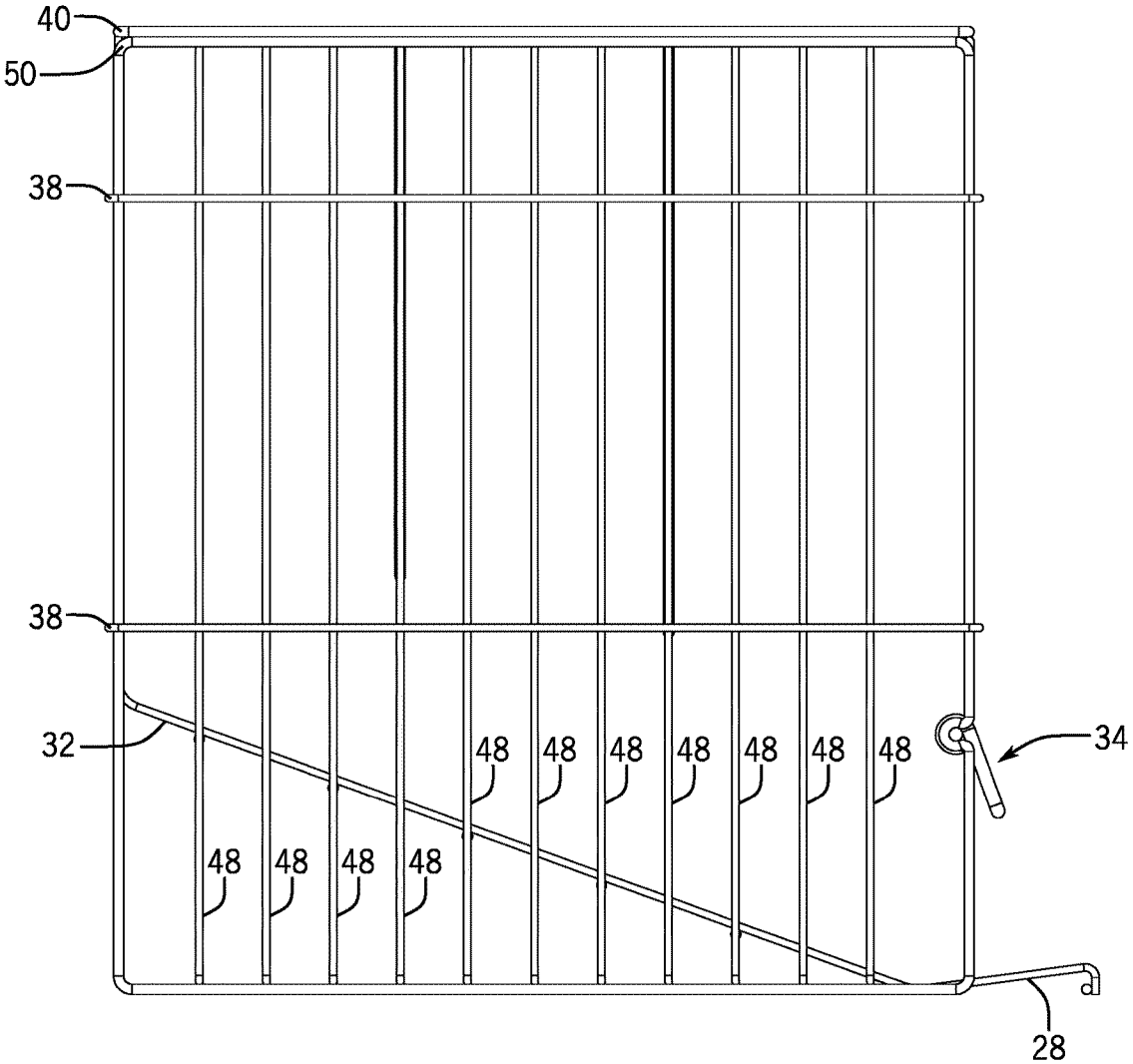

FIG. 4 is a side view of an exemplary embodiment of an organization system.

Figure 5:
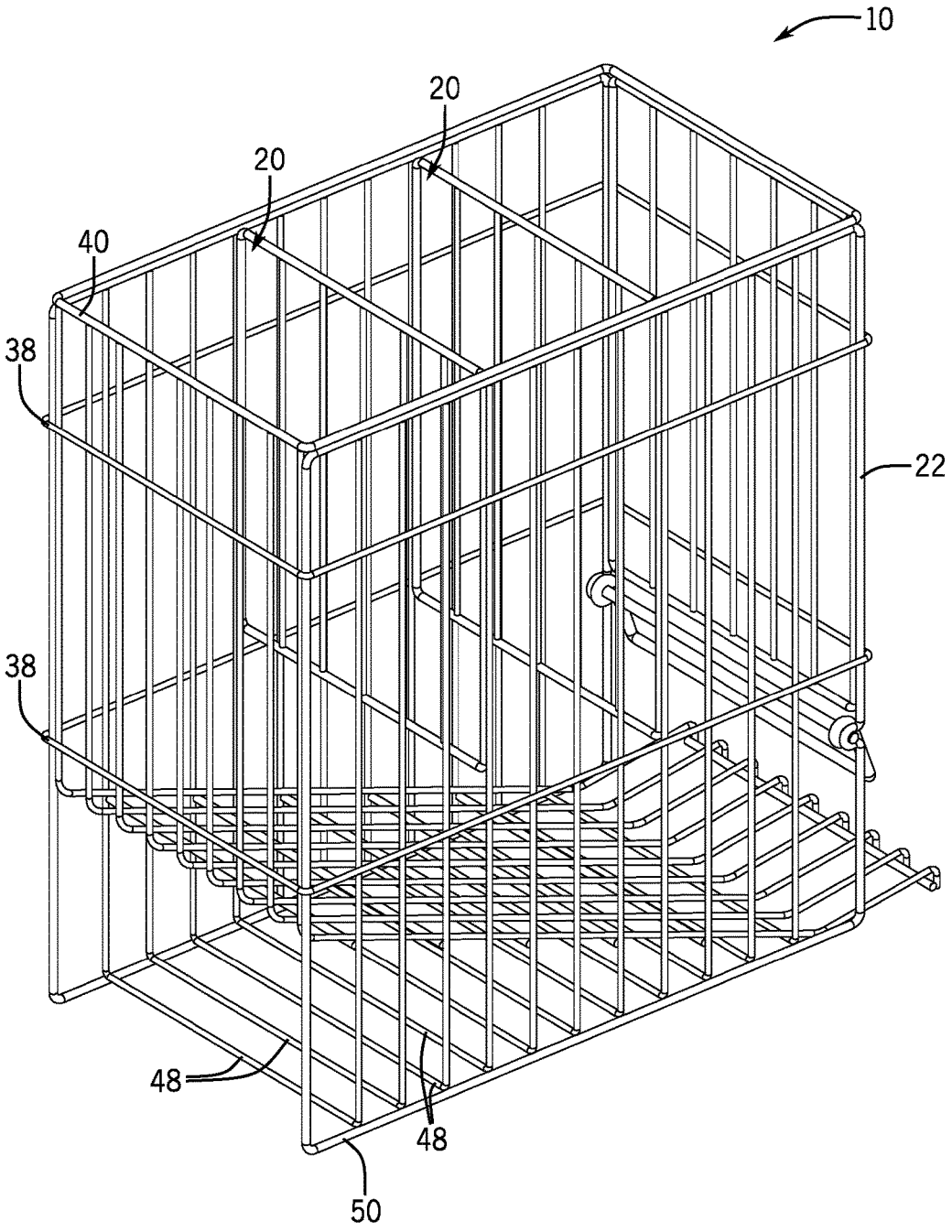

FIG. 5 is a rear perspective view of an exemplary embodiment of an organization system.

Figure 6:
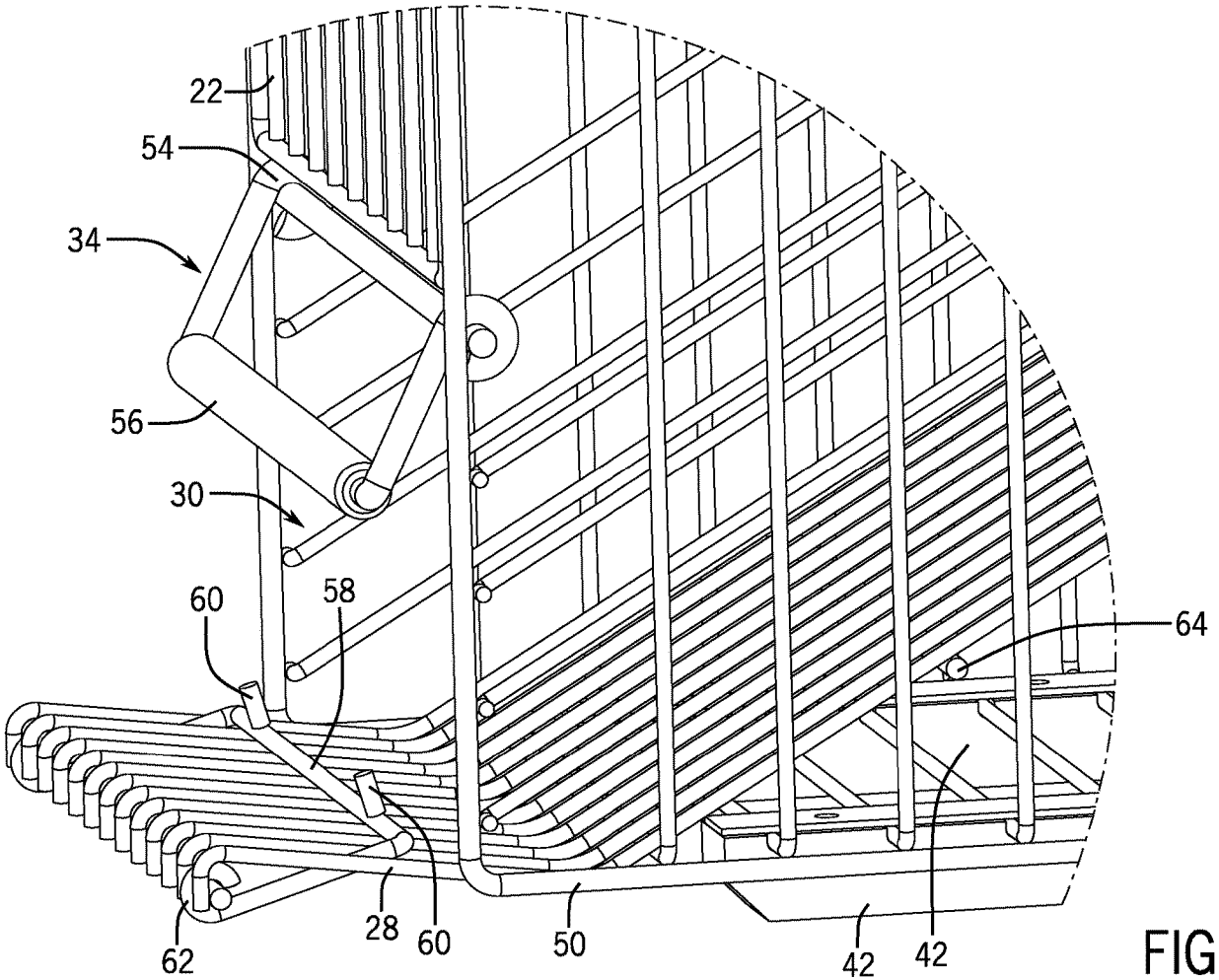

FIG. 6 is an enlarged view of the portion of FIG. 3 denoted by line 6-6.

DETAILED DISCLOSURE

FIG. 1 depicts an exemplary embodiment of a bag organization system 10 located within a freezer 12. Solely for the purposes of depiction, the freezer 12 is shown without a door, although it will be recognized that any of a variety of door configurations or designs may be used with embodiments of freezers 12. While not necessarily limiting, the freezer 12 is shown and described herein as a side-open freezer, as opposed to a top-open freezer or a drawer freezer. Still other freezers may include an open front, a partially enclosed front, or a flexible door or flap. Additionally, the freezer 12 is depicted including casters 14 and the freezer is configured in a generally square or cubic shape. However, it will be recognized that freezer 12 may take any of a variety of shapes or dimensions while remaining within the scope of the present disclosure and that exemplary embodiments of the organization system 10 depicted and described herein may be dimensioned and configured for suitable use within interior freezer dimensions. While a single bag organization system 10 is depicted, it will be recognized that multiple organization systems 10 may be used within a single freezer.

The organization system 10 is configured to receive and retain a plurality of bags 16 filled with frozen food items. In exemplary embodiments, the frozen food items may be any of a variety of known frozen food items including, but not limited to French fries, tater tots, onion rings, jalapeno poppers, mozzarella sticks, breaded mushrooms, cheese curds, fish sticks, chicken nuggets, or chicken tenders. As an exemplary and non-limiting embodiment, the remaining disclosure will use the example of chicken nuggets, although it will be recognized by a person of ordinary skill in the art that any of the above or any other similar or related food items may similarly be used.

Exemplarily, the organization system 10 includes a plurality of bays 18 which are defined by one or more divider walls 20 and one or more of a front wall 22 or a back wall 24. A dispensing ramp 26 is positioned below each of the bays 18 as well as the divider walls 20.

The dispensing ramp 26 directs the bags 16 downwardly at an angle towards a landing platform 28 at a dispenser opening 30. In an exemplary embodiment as will be described in further detail herein, the back wall 24, the dispensing ramp 26, and the landing platform 28 may be constructed as a unitary construction forming a bag chute 32. In an embodiment, the back wall 24, the dispensing ramp 26, and the landing platform 28 may be constructed by a series of wires arranged in parallel along a length-wise dimension of the bag chute 32. The series of wires may be evenly spaced apart and held in position by their mutual securement to a plurality of support rods 64 as will be described in further detail herein.

A retainer gate 34 is pivotably secured to the front wall 22 and exemplarily engages a bag 16 located at the landing platform 28 in the dispenser opening 30 and places a biasing force on the bag 16 to resist the bag from sliding further outwards from the organization system 10. The retainer gate 34 includes a retainer weight 56 that further increases the biasing force provided by the retainer gate 34 against the bag 16.

The divider walls 20 are arranged in a spaced relationship relative to each other and also spaced apart from the dispensing ramp 26. The divider walls 20 are spaced apart from adjacent divider walls 20 and/or an adjacent front wall 22 or back wall 24 to define a plurality of bays 18 configured to receive and retain bags of frozen food. The bays 18 are configured through dimensioning between the adjacent walls to accommodate a single bag in a width dimension such that the bags stack upon one another within the bay 18. Bottom ends of the divider walls 20 are spaced apart from the dispensing ramp in a configuration to place a resistance against a bag moving down the dispensing ramp 26. Dimensioning of the distance between the bottom end of the divider wall 20 and the top surface of the dispensing ramp 26 creates a passage configured to permit a bag of frozen food to pass, but one in which the divider wall 20 resists movement of the bag of frozen food past the divider wall 20. In such embodiments, the bag of frozen food may require deformation or other pliability of the bag of frozen food to move past the divider wall 20. Because of this resistance, bags of frozen food are prevented from moving past a divider wall 20 and down the dispensing ramp until the path forward is clear by first dispensing the all of the bags located in the forward bay 18A. In this manner, the organization system 10 is operable to establish a dispensing order among the bags to facilitate a first in, first out inventory management system. In an exemplary embodiment, the organization system 10 dispenses the bags from bottom to top sequentially on a per bay basis from the forward bay 18A to the middle bay 18B, to the rear bay 18C.

It will be recognized that in embodiments, the organization system 10 may be constructed in any of a variety of known manners, including, but not limited to a construction of plastic or other composite materials and may be constructed with solid or perforated walls. In an exemplary embodiment, the walls may be transparent or translucent or include a transparent, translucent, or open portion such that remaining bag inventory within the organization system may be easily observed, determined, and evaluated.

In still further exemplary embodiments, the organization system 10 may be constructed in a wire frame assembly as depicted in FIGS. 2-6. FIG. 2 is a front perspective view of an exemplary embodiment of an organization system 10. FIG. 3 is a side perspective view of an exemplary embodiment of the organization system 10. FIG. 4 is a side view of an exemplary embodiment of the organization system 10. FIG. 5 is a rear perspective view of the organization system 10. FIG. 6 is an enlarged view of a portion of the organization system 10.

In the embodiments of the organization system 10 depicted in the FIGS. 2-6, the organization system 10 is exemplarily constructed of bent wire frames. It will be recognized that the organization system may be constructed in other manners as well, including constructed from plastic or other materials, or may be constructed with some or all of the walls or structures being solid rather than wire form. In the organization system 10 two divider walls 20 are provided to create three bays 18A-18C. The forward bay 18A is exemplarily defined between a first divider wall 20 and the front wall 22. The middle bay 18B is defined between the divider walls 20. The rear bay 18C is defined between a divider wall 20 and the back wall 24 which is exemplarily constructed as part of a bag chute 32 and can be exemplarily seen in FIGS. 3-5.

The organization system 10 further includes side walls 36. The side walls may include a frame bar 50 that defines the outer perimeter of the side wall 36. The side walls 36 may be independently constructed of interconnected wires or the like. In another embodiment as described in further detail herein, the side walls 36 may be formed of the frame bars 50 to which a plurality of wires (in a generally U shape) are secured to form the bottom and the sides as a single assembly. The front wall 22, side walls 36, and bag chute 32 are exemplarily secured to one another with the use of one or more support rings 38. The support rings 38 may secure each of the front wall 22, side walls 36, and bag chute 32 to each other exemplarily by a friction fit, or by welding or mechanical fasteners between points of engagement between the various components. While these are not depicted in the drawings a person of ordinary skill in the art will recognize various embodiments of fasteners and/or welding which may be used to secure wire frame components together. In an exemplary embodiment, a support ring may further be located at the top of the organization system 10 and as such may represent a top ring 40 to which the components are secured.

As best seen by reference to FIGS. 2 and 3, embodiments of the organization system 10 further include runners 42 positioned at a bottom of the organization system 10. The runners 42 may be constructed of a plastic and/or other elastomeric material. In embodiments, the runners, dependent upon the construction and material of the runners 42 may facilitate placement and withdrawal of the organization system 10 within the freezer may also facilitate retention of the organization system 10 within the freezer, depending upon the softness or pliability of the runners 42. The runners 42 exemplarily configured with a plurality of recesses 44 which are each configured to receive a wire of a bottom frame 46. The person of ordinary skill in the art will further recognize that in embodiments, the sidewalls 36 and the bottom frame 46 may be unitary in construction such as to resemble a U shape. In a still further exemplary embodiment, the bottom frame 46 and the sidewalls 36 may be constructed of a plurality of similarly constructed U shaped wire members 48 which are exemplarily secured to one another through engagement with the runners 42, a frame bar 50 of the sidewall 36, as well as with the support ring 38, top ring 40, and the bag chute 32.

In an exemplary embodiment, a retaining plate 52 secured over the top of the wires located in the recesses 44 to secure the wires to the runner 42. In an exemplary embodiment, the retaining plates 52 may be secured to the runners 42 with a series of screws, rivets, or other mechanical fasteners between these two components.

As best depicted in FIGS. 2, 3, and 6, embodiments of the organization system 10 further include a retainer gate 34 which is exemplarily pivotably secured to a pivot rod 54 which may be separate from or a part of the front wall 22. The retainer gate 34 further includes a retainer weight 56. The retainer weight 56 may exemplarily be a cylinder or a tube formed about a portion of the retainer gate 34. The retainer weight 56 may take other forms other than those as depicted in the present figures and performs the function of providing additional weight at the free end of the retainer gate 34 to create a biasing force by gravity against a bag positioned on the landing platform 28 within the dispenser opening 30. In another embodiment, the retainer weight 56 may be integral with the retainer gate 34, the retainer gate 34 being formed of a larger dimension than other components of the organization system 10 and/or of a heavier material than other components of the organization system 10. This biasing force against the bag from the retainer gate 34 as facilitated by the retainer weight 56 helps to retain the next bag for dispense in the appropriate position while holding the remaining bags within the organization system 10 prior to dispense.

Additionally, a shelf lock 58 is pivotably secured to the landing platform 28. The shelf lock 58 is exemplarily constructed with one or more fingers 60 that project from the shelf lock 58 and are configured to secure over a front lip of a freezer space or cavity. The shelf lock 58 is exemplarily pivotably connected to a frame of the dispensing platform 26 exemplarily by pivot loops 62 secured to the shelf lock 58. FIGS. 2 and 3 exemplarily show the shelf lock 58 in a deployed or locking configuration in a manner such that the fingers 60 are in a relative position to engage a lip of a freezer. In FIG. 6, the shelf lock 58 is exemplarily pivoted into a retracted condition, for example to facilitate storage or transport of the organization system 10. In a further exemplary embodiment, the organization system 10 may be used as a caddy whereby the organization system 10 is loaded with bags at a location outside of the freezer and carried to the freezer and positioned within the freezer after the organization system 10 is filled. In such an embodiment, when the organization system 10 is filled with bags of food and no bags have yet to be dispensed, the combination of the shelf lock 58 and the retainer gate 34 can help to keep all of the bags of food within the organization system 10. When the organization system 10 is installed within the freezer, the shelf lock 58 is pivoted into the deployed or locking condition which helps to retain the organization system 10 in position within the freezer and also removes an obstruction from the dispenser opening 30 so that bags of food may be withdrawn from the organization system 10.

Bottom support rods 64, as best depicted in FIG. 3, exemplarily secure between the individual wires of the bag chute 32 and in further exemplary embodiments, the bottom support rod 64 further facilitates securing of the bag chute 32 to the wires 48 of the sidewalls 36. This gives further rigidity and strength to the bag chute 32 such that the bags of food are rigidly supported within the organization system 10. Additionally, exemplary embodiments of the organization system 10 further include side projections 66, which may exemplarily be a series of wire form rods which exemplarily extend between front and back sides of the frame bars 50 in a region about the bag chute 32. The side projections 66 are exemplarily located internal to the organization system 10 from the side walls formed by wires 48. While the side projections 66 interconnect the frame bars 50 and the wires 48, the side projections 66 further provide a smooth support along which the bags of food may slide as the bags of food move along the bag chute 32. In a further exemplary embodiment, the ends of the wires forming the side projections 66 are turned outwards so as to further limit or avoid exposure of the bags to sharp edges or corners and to facilitate a smooth engagement path along the length of the organization system 10 along the bag chute 32.

In embodiments, the side projections are located interior of the wires 48 of the side walls and engage the bags of frozen food, limiting engagement between the bags and the vertically-oriented wires 48. Sliding friction along the side projections improves urging of the bags of frozen food down the bag chute 32, which mitigates against jamming within the organization system 10. The bags of frozen food would otherwise tend to catch on the wires 48. The wires of the bag chute 32 provide a similar function over the supports 64 which are generally oriented orthogonal to the direction of travel down the chute 32. In still further embodiments of the organization system 10, wherein the embodiment is constructed of solid walls and a bag chute as opposed to the wire form construction depicted in the figures, the side projections of the side walls and chute projections as embodied by the wires of the bag chute 32 provide a similar function by reducing sliding friction over smooth surfaces. In still further embodiments, the side walls and bag chute 32 may be provided with other surface textures as well.

In the present Description, certain terms have been used for brevity, clearness, and understanding. No unnecessary limitation are to be implied therefrom beyond the requirement of the prior art because such terms are used for descriptive purposes only and are intended to be broadly construed. The different dispenser apparatuses, systems, and methods described herein may be used alone or in combination with other apparatuses, systems, and methods. Various equivalents, alternatives, and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An organization system for use with bagged food product in a temperature controlled environment, the organization system comprising:

opposed side walls;

a dispensing ramp arranged at an angle between the opposed side walls;

a front wall extending between the opposed side walls, a space between the front wall and the dispensing ramp defining a dispenser opening;

a first divider wall extending between the opposed side walls, the divider wall extending in an elongated dimension with a lower end spaced apart from the dispenser ramp by a predetermined distance;

a rear wall extending between the opposed side walls;

a second divider wall extending between the opposed side walls at a position between the first divider wall and the rear wall, wherein the second divider wall extends in an elongated dimension with a lower end of the second divider wall spaced apart from the dispenser ramp by the predetermined distance; and a plurality of side projections located along interior surfaces of the opposed side walls, wherein the side projections are arranged parallel to the dispenser ramp, wherein the predetermined distance is based upon a dimension of a bagged food product such that the bagged food product deforms to move through the predetermined distance between the second divider wall and the dispenser ramp and the first divider wall and the dispenser ramp.

2. The organization system of claim 1, wherein the first divider wall is spaced apart from the front wall by a predetermined width and the second divider wall is spaced apart from the rear wall by the predetermined width, wherein the predetermined width is based upon a dimension of a bagged food product such that the bagged food product forms a first stack between the front wall and the first divider wall and forms a second stack between the second divider wall and the rear wall.

3. The organization system of claim 1, further comprising a unitary bag chute comprising the dispensing ramp, the rear wall, and a landing platform that extends from the dispensing ramp exterior of the dispenser opening.

4. The organization system of claim 1, further comprising a retainer gate pivotably attached to the front wall to movably and partially occlude the dispenser opening.

5. An organization system for use with bagged food product in a temperature controlled environment, the organization system comprising:

opposed side walls;

a dispensing ramp arranged at an angle between the opposed side walls;

a front wall extending between the opposed side walls, a space between the front wall and the dispensing ramp defining a dispenser opening;

a first divider wall extending between the opposed side walls, the divider wall extending in an elongated dimension with a lower end spaced apart from the dispenser ramp by a predetermined distance;

a rear wall extending between the opposed side walls;

a second divider wall extending between the opposed side walls at a position between the first divider wall and the rear wall, wherein the second divider wall extends in an elongated dimension with a lower end of the second divider wall spaced apart from the dispenser ramp by the predetermined distance;

a landing platform that extends from the dispensing ramp exterior of the dispenser opening; and a shelf lock pivotably secured to an end of the landing platform, the shelf lock comprising at least one finger extending from a free end of the shelf lock.

6. The organization system of claim 5, wherein the first divider wall is spaced apart from the front wall by a predetermined width and the second divider wall is spaced apart from the rear wall by the predetermined width, wherein the predetermined width is based upon a dimension of a bagged food product such that the bagged food product forms a first stack between the front wall and the first divider wall and forms a second stack between the second divider wall and the rear wall.

7. The organization system of claim 5, further comprising a unitary bag chute comprising the dispensing ramp, the rear wall, and a landing platform that extends from the dispensing ramp exterior of the dispenser opening.

8. The organization system of claim 5, further comprising a retainer gate with a weighted free end, the retainer gate pivotably attached to the front wall to movably and partially occlude the dispenser opening.

9. The organization system of claim 8, further comprising at least one elastomeric runner secured to a bottom of the organization system.

10. The organization system of claim 5, further comprising a retainer gate pivotably attached to the front wall to movably and partially occlude the dispenser opening.

11. The organization system of claim 10, wherein the retainer gate is weighted at a free end of the retainer gate.

12. The organization system of claim 11, wherein the retainer gate further comprises a tube positioned about a portion of the retainer gate.

13. An organization system for use with bagged food product in a temperature controlled environment, the organization system comprising:

opposed sidewalls that each comprise a frame bar that defines an outer perimeter of a respective sidewall and the opposed sidewalls are formed by a plurality of U-shaped wires secured between the frame bars of both of the opposed sidewalls;

a dispensing ramp arranged at an angle between the opposed side walls;

a front wall extending between the opposed side walls, a space between the front wall and the dispensing ramp defining a dispenser opening; and a divider wall extending between the opposed side walls, the divider wall extending in an elongated dimension with a lower end spaced apart from the dispenser ramp by a predetermined distance.

14. The organization system of claim 13, further comprising at least one retaining ring that secures the front wall, opposed side walls, the dispensing chute, the divider walls, and a rear wall together by a compression fit.

15. The organization system of claim 13, wherein the U-shaped wires define a bottom frame between the opposed sidewalls.

16. The organization system of claim 15, further comprising a runner comprising a plurality of recesses, the runner receives each of the U-shaped wires of the bottom frame within a respective recess of the plurality of recesses.

17. The organization system of claim 16, further comprising a retaining plate secured to the at least one runner over the plurality of recesses to secure the U-shaped wires with the recesses of the plurality of recesses.

18. The organization system of claim 13, further comprising a plurality of side projections located along interior surfaces of the opposed side walls, wherein the side projections are arranged parallel to the dispenser ramp and are connected at least between opposed sides of each of the frame bars.

19. The organization system of claim 18, wherein the plurality of side projections of a respective sidewall are secured to each of the U-shaped wires of the respective sidewall.

20. The organization system of claim 18, further comprising a plurality of side support rods secured to each of the opposed side walls in an arrangement orthogonal to the dispensing ramp, wherein the dispensing ramp comprises a plurality of wires arranged orthogonal to the plurality of side support rods.

* * * * *